US005535721A

United States Patent [19]

Lewis et al.

[11] Patent Number: 5,535,721

[45] Date of Patent: Jul. 16, 1996

[54] FUEL PUMP

[75] Inventors: Graham R. Lewis, Gillingham; Peter J. Parr, Maidstone, both of England

[73] Assignee: Lucas Industries p.l.c., England

[21] Appl. No.: 518,181

[22] Filed: Aug. 23, 1995

[30] Foreign Application Priority Data

Aug. 24, 1994 [GB] United Kingdom ..... 9417062

[51] Int. Cl.[6] ..... F02D 31/00; F02B 77/00

[52] U.S. Cl. ..... 123/359; 123/365

[58] Field of Search ..... 123/357, 359, 123/365, 198 D

[56] References Cited

U.S. PATENT DOCUMENTS 4,343,274 8/1982 Butschev ..... 123/359
4,616,616 10/1986 Staniak et al. ..... 123/365
4,729,357 3/1988 Freudenschuss et al. ..... 123/365
4,750,463 6/1988 Peter et al. ..... 123/365
4,893,599 1/1990 Melnik ..... 123/359
5,388,562 2/1995 Sekiguchi ..... 123/359

*Primary Examiner*—Thomas N. Moulis
*Attorney, Agent, or Firm*—Andrus, Sceales, Starke & Sawall

[57] ABSTRACT

A fuel pumping apparatus for supplying fuel to an engine incudes an angularly adjustable throttle for determining the amount of fuel supplied to the engine. The setting of the throttle in normal operation is determined by an actuator which is controlled by an electronic control system. A mechanical governor is provided which is coupled to the throttle member by a sliding link and this acts to prevent the speed of the engine exceeding a predetermined value. In the event of failure of the actuator or control system a pivotal arm is moved to an emergency run position in which the actuator is decoupled from the throttle member and the force exerted by the governor spring of the mechanical governor is reduced to allow the engine to operate at a reduced speed.

5 Claims, 3 Drawing Sheets

FUEL PUMP

This invention relates to a fuel pumping apparatus for supplying fuel to an internal combustion engine, the apparatus comprising a high pressure pump, arranged in use to be driven by the associated engine, adjustable fuel quantity determining means for controlling the amount of fuel delivered by the high pressure pump to the engine, an electrical actuator coupled to said means, said actuator in use being supplied with an electrical signal by a control circuit responsive to at least one engine operating parameter and a desired operating parameter and a mechanical governor operable in the event that the engine speed exceeds a predetermined value, to move said fuel quantity determining means to reduce the amount of fuel supplied to the engine thereby to limit the engine speed.

The control circuit is arranged to provide a governing action but in the event of failure of the control system or the actuator, the fuel determining means will either move to a minimum or zero fuel supply position or to the maximum fuel position. In the former case the engine will stop but in the latter case the engine could accelerate beyond its normal maximum speed. The action of the mechanical governor is to limit the engine maximum speed. In either case however the engine can no longer be used for its intended purpose such for example as driving a vehicle.

The object of the invention is to provide an apparatus of the kind specified in a simple and convenient form.

According to the invention an apparatus of the kind specified comprises manually operable means movable from a normal setting in which the mechanical governor acts only to control the engine speed above said predetermined value, to an emergency setting in which the actuator is decoupled from the quantity determining means and the mechanical governor is set to control the setting of the quantity determining means so that the engine speed is governed at an intermediate speed below said predetermined speed.

Figure 1:
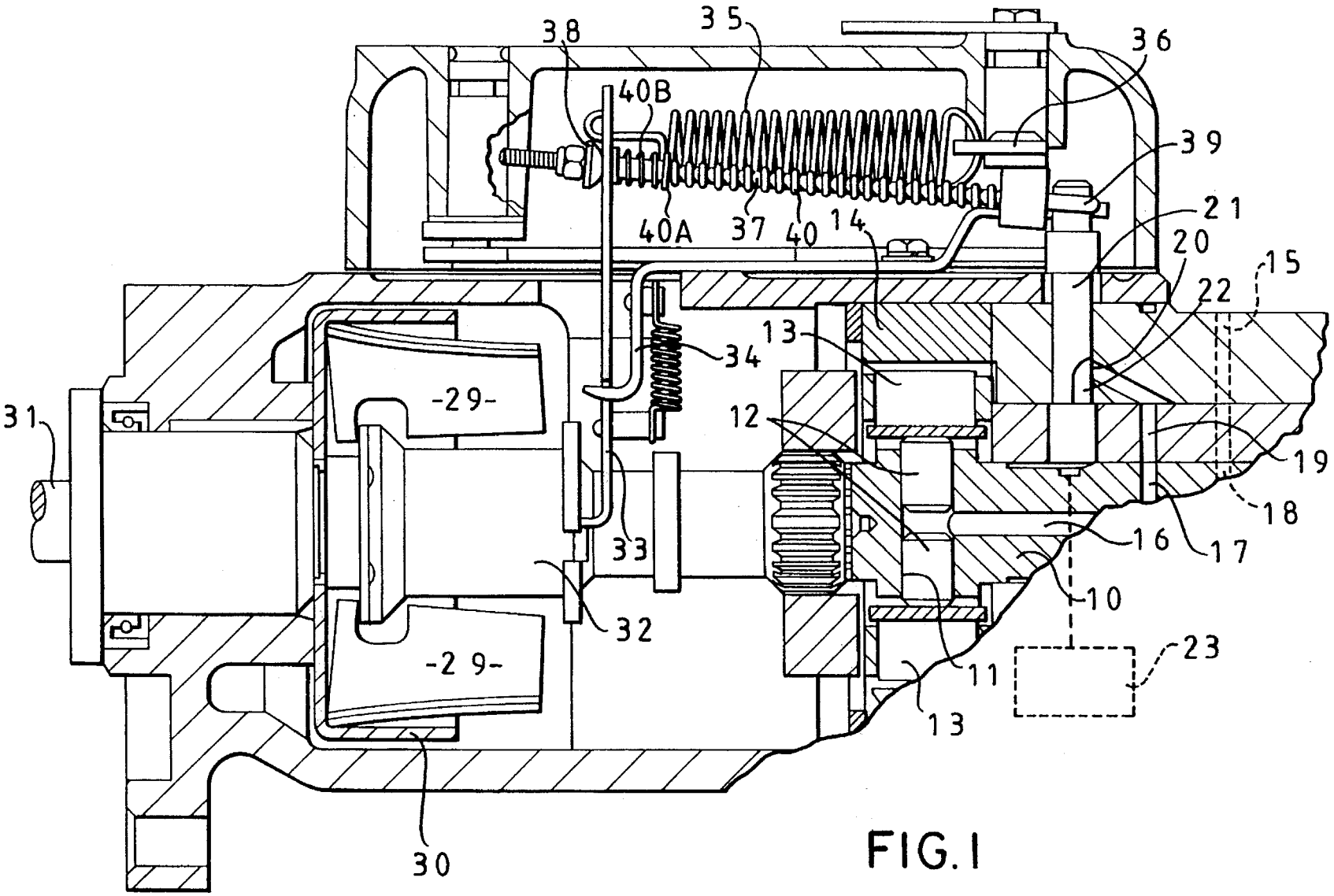
Figure 2:
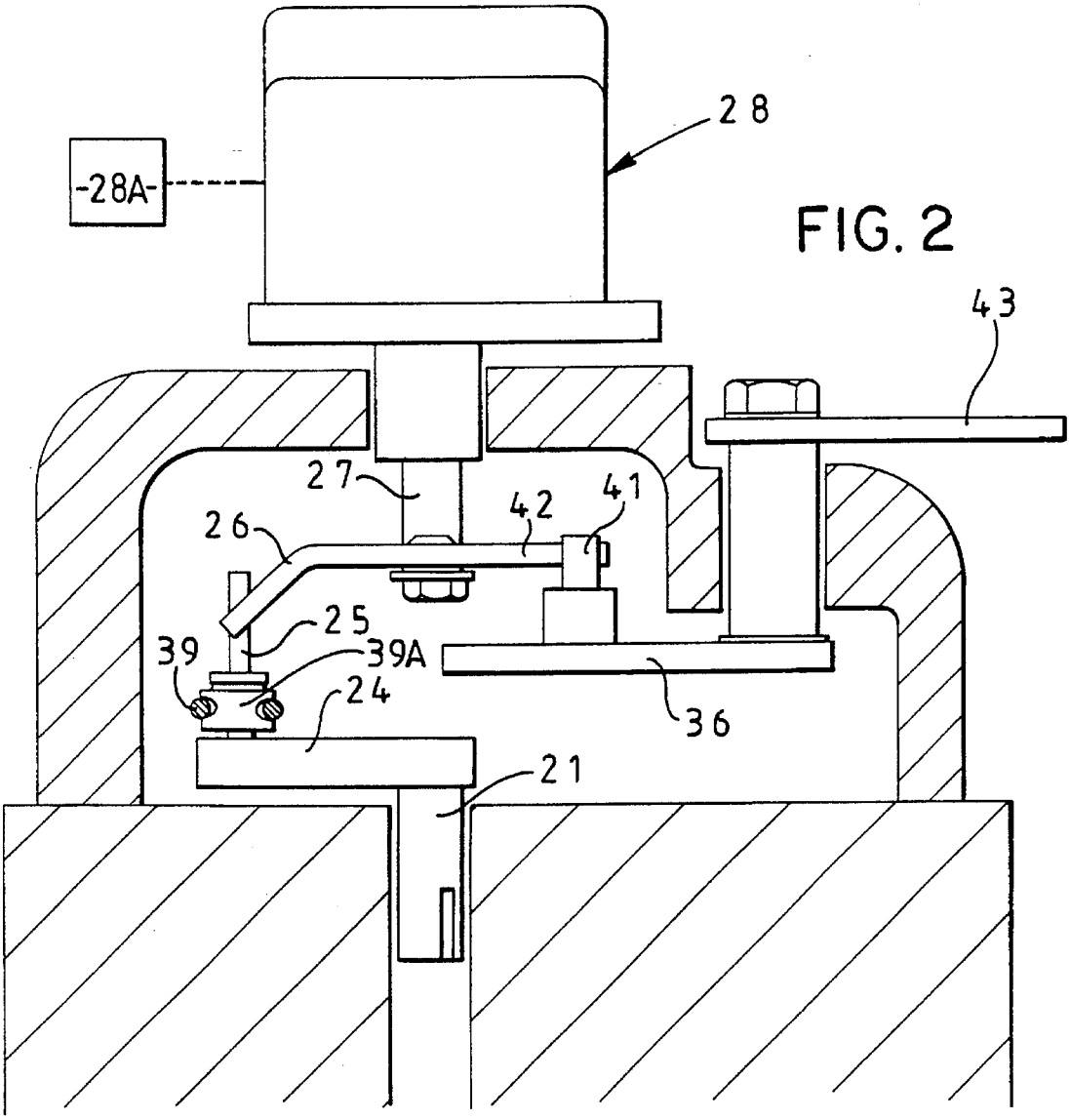
Figure 3:
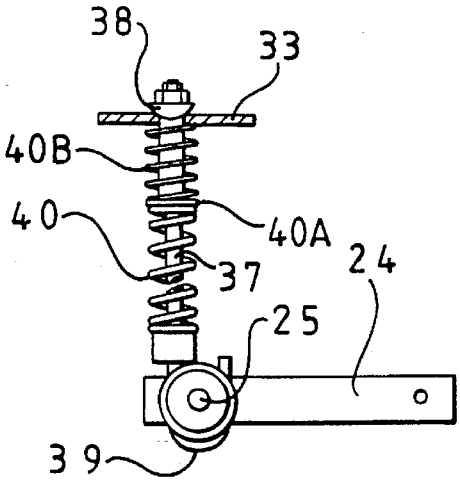
Figure 4:
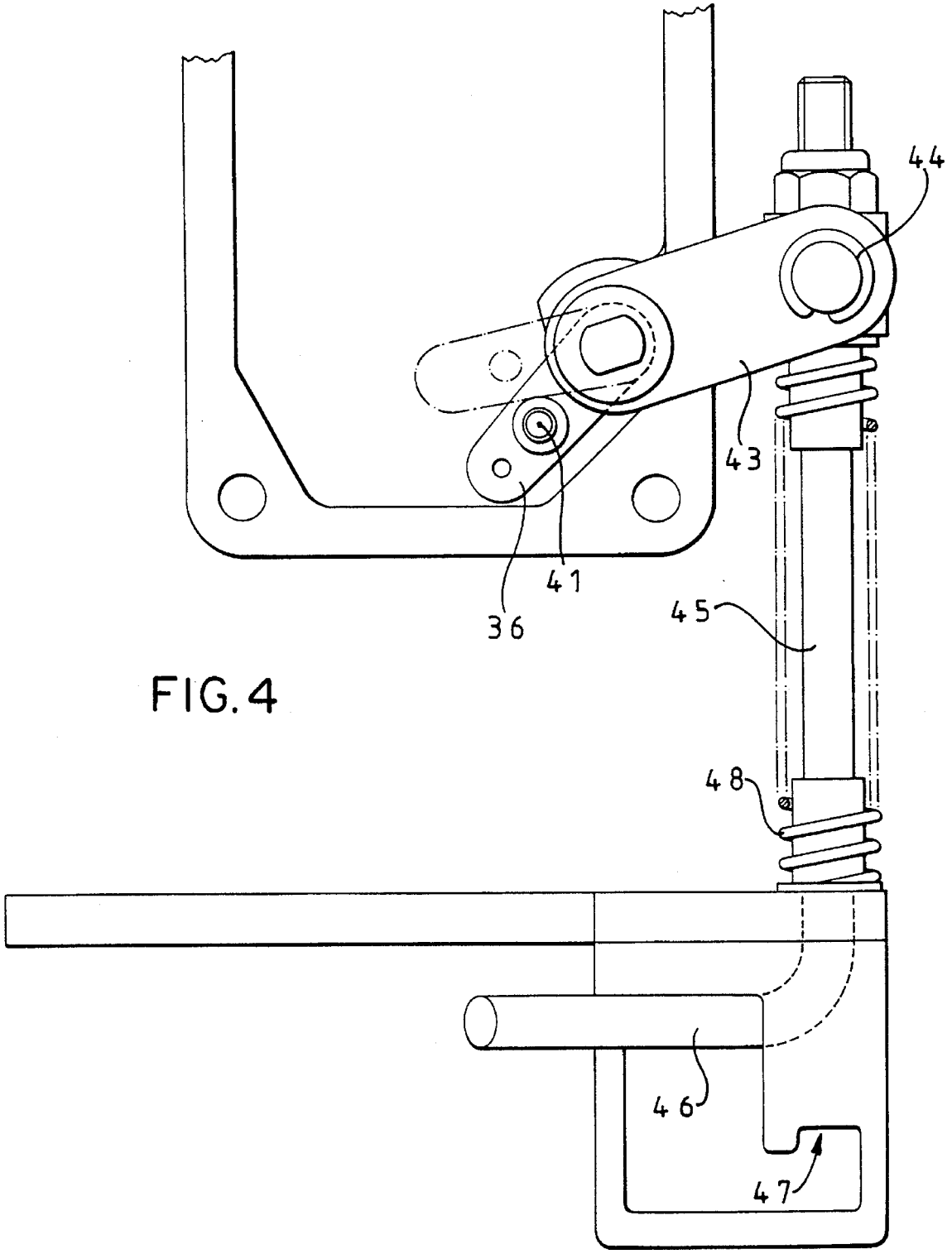

An example of an apparatus in accordance with the invention will now be described with reference to the accompanying drawings in which:

FIG. 1 is a part sectional side elevation of a mechanically governed fuel pumping apparatus, FIG. 2 is an end view with parts removed for the sake of clarity, of part of the apparatus seen in FIG. 1, modified in accordance with the invention, FIG. 3 is a plan view of a portion of the apparatus seen in FIG. 1, and FIG. 4 shows an additional part of the apparatus not seen in the preceding drawings.

Referring to FIG. 1 of the drawings the fuel pumping apparatus comprises a rotary distributor pump of conventional type and having a rotary distributor member 10 in which is formed a transverse bore 11 which houses a pair of pumping plungers 12. The pumping plungers at their outer ends engage cam followers 13 respectively and these are engagable by cam lobes formed on the internal peripheral surface of an annular cam ring 14 mounted within the housing of the apparatus. The pumping plungers form in conjunction with the cam lobes a high pressure pump.

The housing defines outlet ports 15 only one of which is shown, for connection to the injection nozzles respectively of the associated engine and the distributor member is provided with a central passage 16 which communicates with the bore 11 intermediate the plungers 12. The central passage communicates with a plurality of inlet ports 17 formed in the distributor member and also with a delivery passage 18 the latter being positioned to register in turn during the inward movement of the pumping plungers, with one of the outlet ports 15. The inlet passages 17 are positioned to communicate in turn during the periods when the pumping plungers are allowed to move outwardly, with an inlet passage 19 which opens at a port 20, into a bore which accommodates an angularly adjustable throttle member 21. The throttle member is provided with a groove 22 for adjustable registration with the port 20. Below the throttle member is a space which is connected to the outlet of a low pressure pump 23 which conveniently is a vane pump having its rotor secured to the distributor member so as to rotate therewith.

In operation, the amount of fuel supplied to the bore 11 can be determined by adjusting the angular setting of the throttle member 21 and this determines the amount of fuel which is supplied to the associated engine.

In order to control the setting of the throttle member 21 the latter is provided with an arm 24 upstanding from which as seen more clearly in FIG. 2, is a pin 25 which is engagable by an arm 26 mounted at the end of an angularly adjustable shaft 27 extending from an electrically operated actuator 28. The pin 25 is spring biased into engagement with the arm 26 by resilient means to be described. The actuator 28 is supplied with electric current under the control of a control circuit 28A which is responsive to the speed of the associated engine and also a desired operating parameter such for example as a driver speed demand signal which is generated by a transducer associated with the throttle pedal of the vehicle driven by the engine. The control circuit 28A acts as a governor and in normal circumstances the driver can control the engine speed by varying the setting of the throttle pedal. If a fault should develop in the actuator or in the control circuit, the arm 26 will either move to cause the throttle member to assume the minimum or zero fuel position or to the maximum fuel position.

In order to control the maximum engine speed in the event of failure of the actuator 28 or the control system 28A, a mechanical governor is provided and this takes the form as indicated in FIG. 1. The mechanical governor comprises a plurality of governor weights 29 which are mounted in a cage 30 located about the drive shaft 31. The weights engage an axially movable sleeve 32 and with increasing speed urge the sleeve towards the right as seen in FIG. 1 of the drawings. The sleeve is engaged by one end of a lever 33 which is pivotally mounted on a bracket 34. The opposite end of the lever is connected to one end of a governor spring 35 the other end of which is connected to a lever 36 which as will be explained is adjustable from exterior of the pump housing. Moreover, interconnecting the other end of the lever 33 and the throttle member is a coupling rod 37 which carries an adjustable abutment 38 at one end and defines a hook portion 39 at its other end. The hook portion 39 is of generally C-shaped form and is engaged about a bush 39A which is mounted on the pin 25 associated with the throttle member. The open end portion of the hook is directed towards the lever 33 and the hook is maintained in engagement with the bush 39A by means of a spring 40 which is wound about the coupling rod 37 and which acts between an abutment block which is slidable on the rod and which engages with the bush, and a plate 40A which is fastened to the rod. A weaker spring 40B is interposed between the plate 40A and the lever 33.

The lever 36 is set so that the mechanical governor has no effect until the engine speed exceeds a predetermined maximum value so that in normal use the spring 40B is compressed and acts to maintain the pin 25 in engagement with the lever 26. When the actuator 28 moves to reduce the quantity of fuel supplied to the engine the throttle member 21 is moved in the clockwise direction as shown in FIG. 3 to further comprises the spring 40B. In the event that the engine speed exceeds the aforesaid predetermined value, the weights 29 move outwardly and the lever 33 engages with the abutment 38 to move the throttle member 21 to reduce the amount of fuel supplied to the associated engine so that the engine maximum speed will be controlled.

As previously stated failure of the control system 28A and/or the actuator 28 may result in the arm 26 moving to the maximum or the minimum fuel positions. In order to provide for a controlled intermediate engine speed to enable the vehicle to be moved or even driven for a short distance, a peg 41 is provided on the arm 36 and is engagable with a further arm 42 which is carried by the shaft 27 of the actuator. The lever 36 is connected to a lever 43 on the exterior of the apparatus and as seen in FIG. 4, the lever 43 is pivotally connected to a bush 44 adjustably mounted on an axially movable rod 45. The rod 45 has a normal run setting as shown in FIG. 4, and an emergency setting in which a cranked end 46 of the rod is engaged within a recess 47. During movement of the end of the rod 46 into the recess 47, the main portion of the rod is moved axially against the action of a spring 48. Moreover, during such movement the lever 43 is moved angularly and this has the effect of relaxing the force exerted on the lever 33 by the governor spring 35 and also causing the pin 41 to engage with the arm 42. This latter movement moves the arm 26 out of engagement with the pin 25 so that the setting of the throttle member is now determined by the mechanical governor. Conveniently in the emergency setting, the force exerted by the governor spring 35 is such that the engine is governed to operate at an intermediate speed which may for example be one third of the normal maximum speed. This will permit the vehicle to be moved and possibly also driven although of course it will be understood that the operator of the vehicle has no control over the engine speed or power output. The position of the bush 44 on the rod 46 can be adjusted to vary said intermediate speed.

We claim:

1. A fuel pumping apparatus for supplying fuel to an internal combustion engine the apparatus comprising a high pressure pump arranged in use to be driven by the associated engine, adjustable fuel quantity determining means for controlling the amount of fuel delivered to the engine from the high pressure pump, an electrical actuator coupled to said means, said actuator in use being supplied with an electrical signal by a control circuit which is responsive to at least one engine operating parameter and a desired operating parameter and a mechanical governor operable in the event that the engine speed exceeds a predetermined value, to move said fuel quantity determining means to reduce the amount of fuel supplied to the engine thereby to limit the engine speed, and manually operable means movable from a normal setting in which the mechanical governor acts only to control the engine speed above said predetermined value, to an emergency setting in which the actuator is decoupled from the quantity determining means and the mechanical governor is set to control the setting of the quantity determining means so that the engine speed is governed at an intermediate speed below said predetermined speed.

2. An apparatus according to claim 1, in which said mechanical governor includes a plurality of weights movable against the action of a governor spring, said manually operable means including a pivotal arm to which one end of the governor spring is connected, whereby when the manually operable means is moved from the normal to the emergency setting, the force exerted by the governor spring is reduced.

3. An apparatus according to claim 2, in which said arm carries a pin operable as the force exerted by the governor spring is reduced, to engage a further arm coupled to an output shaft of the actuator to decouple the output shaft from the quantity determining means.

4. An apparatus according to claim 2, in which said pivotal arm is coupled to a lever external of the apparatus, said lever being coupled to an axially movable rod, spring means operable to bias the rod axially to the normal run position and a latch mechanism operable to hold the rod in the emergency run position after the rod has been displaced against the action of the spring means.

5. An apparatus according to claim 4, in which said lever is pivotally connected to a bush adjustably mounted on said rod whereby the operating speed of the engine in the emergency setting of the rod can be adjusted.

* * * * *